United States Patent [19]

Robertson

[11] Patent Number: 4,598,769

[45] Date of Patent: Jul. 8, 1986

[54] PIPE CUTTING APPARATUS

[76] Inventor: Michael C. Robertson, 904 Valley Ct., Arlington, Tex. 76013

[21] Appl. No.: 689,399

[22] Filed: Jan. 7, 1985

[51] Int. Cl.[4] ..... E21B 29/00; E21B 29/02

[52] U.S. Cl. ..... 166/55; 166/297

[58] Field of Search ..... 166/297, 298, 299, 55, 166/55.1, 55.2, 376; 175/2, 4.6, 4.51; 266/48, 54, 55; 148/9 R; 83/54, 184; 30/92, 106

[56] References Cited

U.S. PATENT DOCUMENTS

| | | | |
|---|---|---|---|
| 2,261,564 | 11/1941 | Robichaux et al. | 166/298 |
| 2,918,125 | 12/1959 | Sweetman | 166/55 X |
| 3,057,295 | 10/1962 | Christopher | 166/55 X |
| 3,318,395 | 5/1967 | Messmer | 166/297 X |
| 4,125,161 | 11/1978 | Chammas | 166/297 |
| 4,184,430 | 1/1980 | Mock | 166/297 X |
| 4,298,063 | 11/1981 | Regalbuto et al. | 166/55 |

*Primary Examiner*—Stephen J. Novosad
*Assistant Examiner*—David J. Bagnell
*Attorney, Agent, or Firm*—Harry C. Post, III

[57] ABSTRACT

Apparatus for cutting a pipe disposed in a pipe string extending from the surface of the earth down a borehole. The apparatus comprises a body having an elongate axis and being adapted to be lowered at a first end down the pipe string to the pipe to be cut, to support a quantity of solid combustible material for providing a pipe cutting flame and to direct the pipe cutting flame along the elongate axis toward a second end of said body. A nozzle is connected to the second end of the body for directing the pipe cutting flame from the elongate axis of the body radially against the pipe to be cut.

16 Claims, 10 Drawing Figures

PIPE CUTTING APPARATUS

It is well known that a pipe string may become stuck in a borehole during drilling and production operations. To recover a portion of the stuck pipe string, it is common practice to use a pipe cutting device to cut the pipe in the pipe string immediately above where the pipe string is stuck. Two types of pipe cutting devices have been used to cut the stuck pipe. One type of pipe cutting device is the high velocity jet cutter and the other is the chemical cutter. The high velocity jet pipe cutter directs a force from an explosive against the pipe to sever it. A problem with this high velocity jet pipe cutter is that the pipe being cut may become flared which increases the difficulty or impossibility of removing the pipe string. The chemical pipe cutter directs an extremely caustic acid, such as hydrogen fluoride, against the pipe to sever it. A problem with this chemical pipe cutter is that special handling is required by the persons attempting to cut the pipe and by the persons transporting the chemical to the job site. Further, neither of these pipe cutters are usable in temperature and pressure conditions that occur in geothermal wells; are usable without positioning the device exactly in the center of the pipe being cut; are usable unless the walls of the device are disposed in close proximity to the pipe being cut; are able to bypass constrictions within the pipe string to reach the pipe to be cut; and are able to cut both an inner and a concentrically disposed outer pipe, such as is required to remove a packer stuck because of a frozen valve.

Accordingly, it is an object of the present invention to provide downhole pipe cutting apparatus that is usable geothermal wells.

Further, it is an object of the present invention to provide downhole pipe cutting apparatus that employs a solid combustible, pyrotechnic material to provide a pipe cutting flame for cutting the pipe.

Further, it is an object of the present invention to provide downhole pipe cutting apparatus that is usable without centering the apparatus exactly in the center of the pipe to be cut.

Further, it is an object of the present invention to provide downhole pipe cutting apparatus of a single size that may be used over a wide range of pipe sizes without resizing the apparatus.

Further, it is an object of the present invention to provide downhole pipe cutting apparatus that is able to bypass constrictions within a pipe string to reach the pipe to be cut.

Further, it is an object of the present invention to provide downhole pipe cutting apparatus that is able to cut more than one pipe to enable removing a stuck downhole packer.

In accordance with the present invention, apparatus for cutting a pipe disposed in a pipe string extending from the surface of the earth down a borehole, comprising a body having an elongate axis. The body is adapted to be lowered at a first end down the pipe string to the pipe to be cut, adapted to support a quantity of solid combustible material for providing a pipe cutting flame and adapted to direct the pipe cutting flame along the elongate axis toward a second end of the body. A nozzle is connected to the second end of the body to direct the pipe cutting flame from the elongate axis of the body radially against the pipe to be cut.

Further, in accordance with the present invention, pipe cutting apparatus is adapted to be moved from the surface of the earth down a pipe string provided in a borehole. The pipe cutting apparatus comprises a body having an elongate axis. A solid combustible material is disposed in the body to provide a pipe cutting flame. A nozzle is connected to the body for directing the pipe cutting flame from a direction extending along the elongate axis of the body toward the pipe to be cut.

Other objects and advantages of the invention will become apparent upon reading the following detailed description and upon reference to the drawings, wherein like reference characters are used throughout to designate like parts and in which.

Figure 1A:
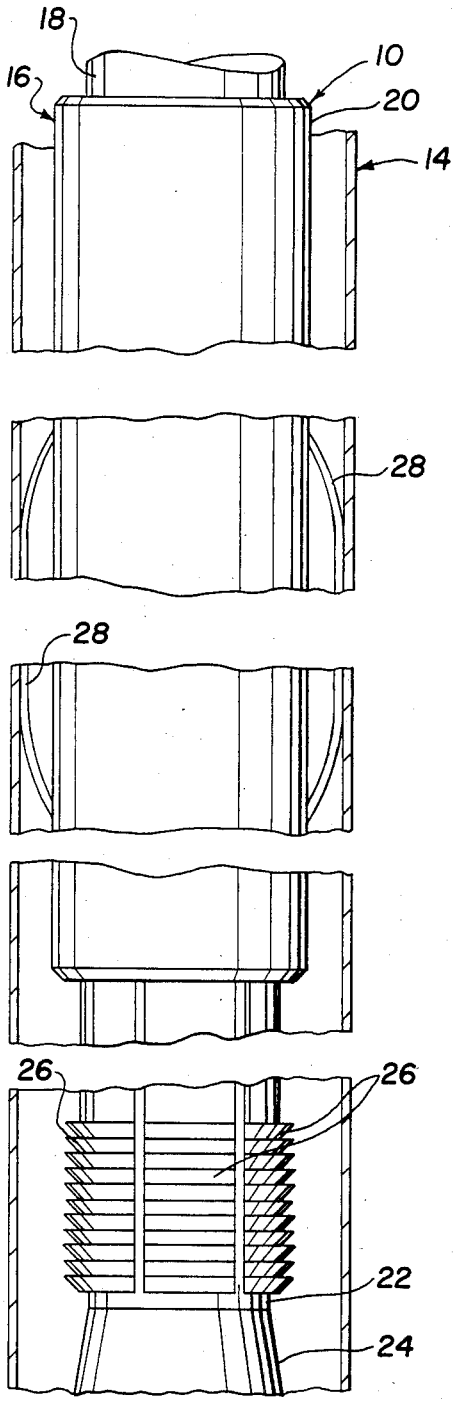
FIG. 1A is an elevational view, partly in section, of pipe cutting apparatus constructed according to the present invention.
Figure 1B:
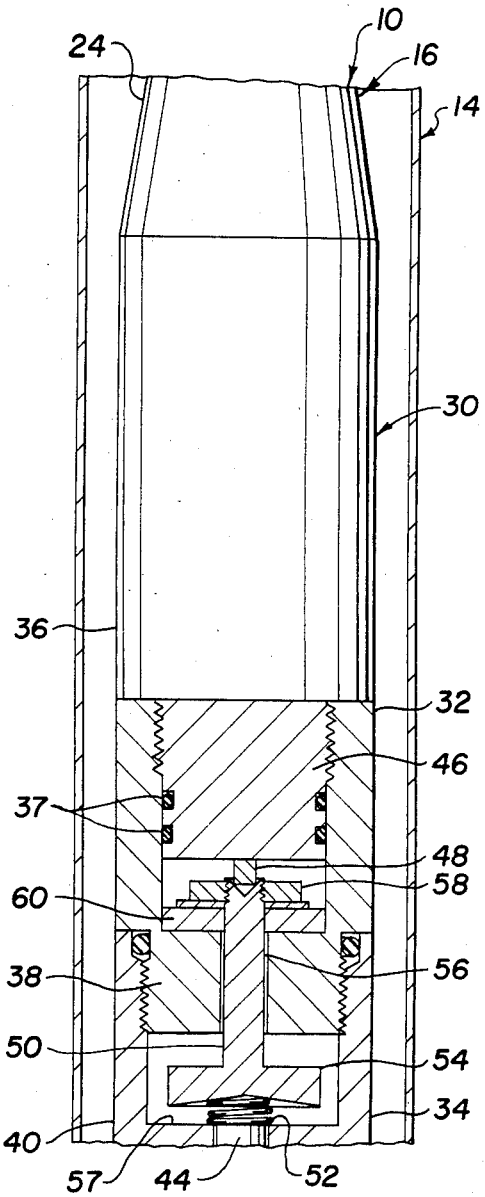
FIG. 1B is an elevational view, partly in section, of pipe cutting apparatus constructed according to the present invention, the apparatus shown in the upper portion of the drawing being connected to the apparatus shown in the lower portion of FIG. 1A.
Figure 1C:
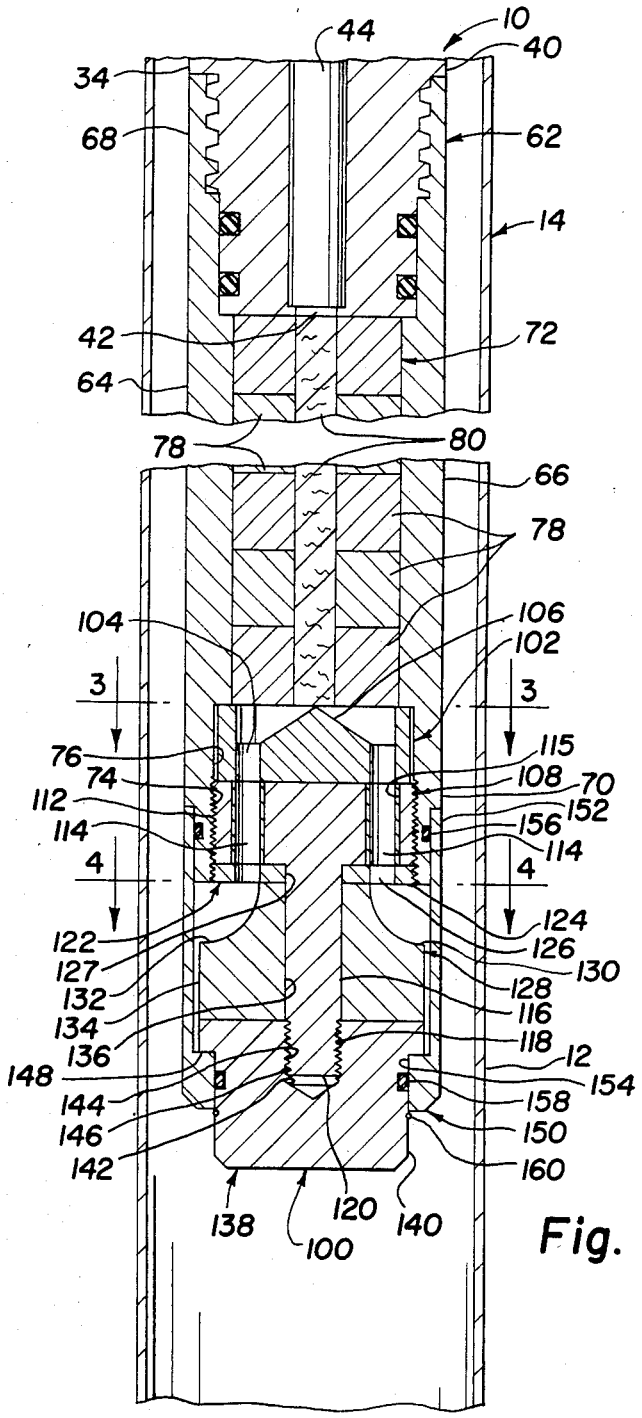
Figure 2:
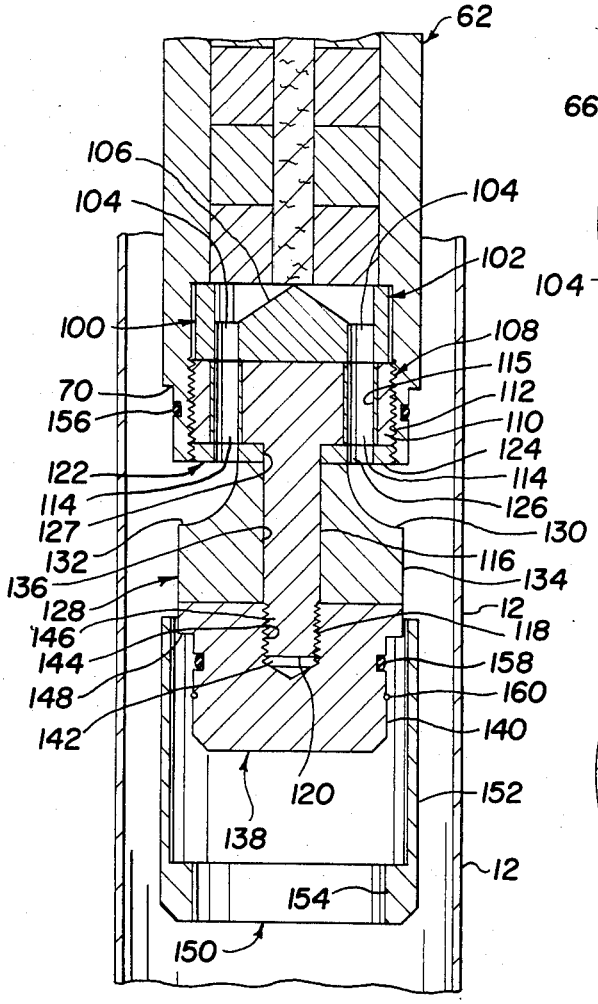
Figure 3:
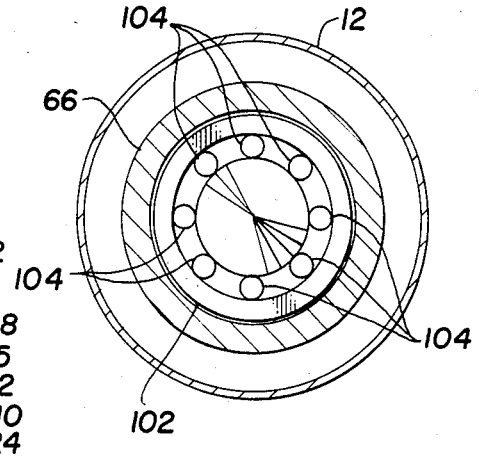
Figure 4:
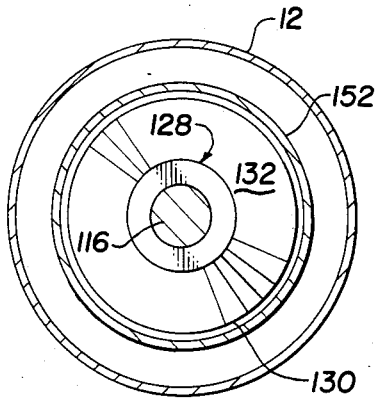
Figure 6:
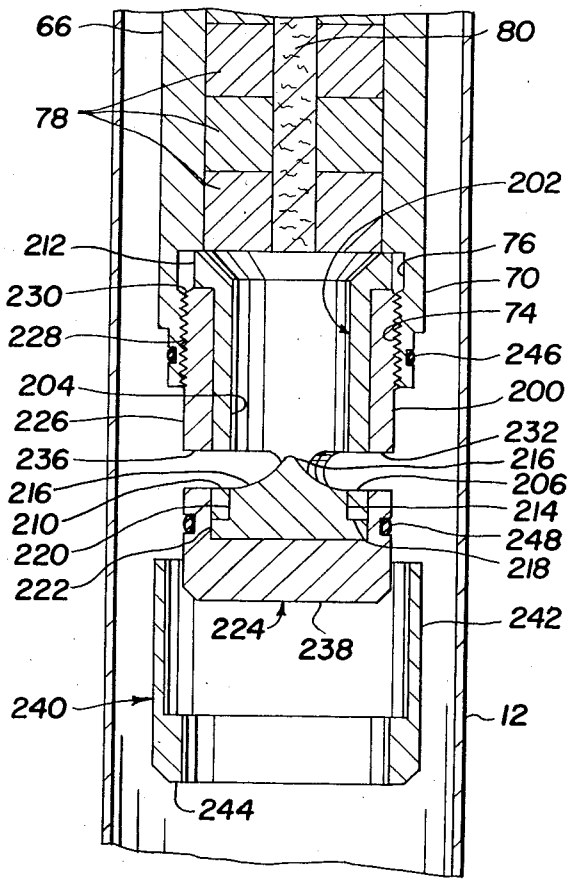
Figure 5:
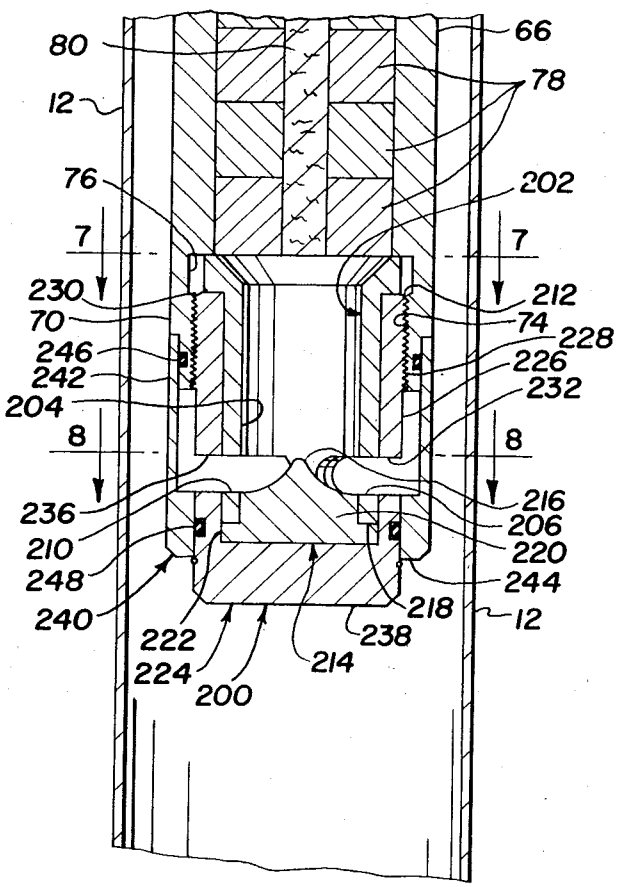
Figure 7:
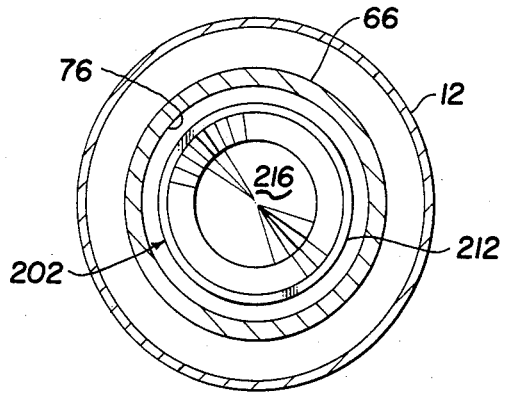
Figure 8:
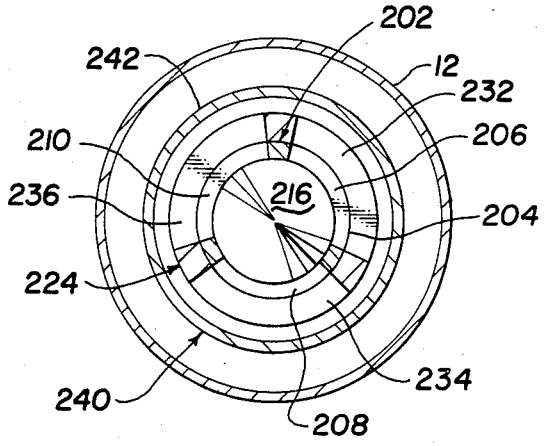

FIG. 1C is a sectional, elevational view of the pipe cutting apparatus constructed according to the present invention, the apparatus shown in the upper portion of the drawing being connected to the apparatus shown in the lower portion of FIG. 1B and the apparatus shown in the lower portion being a first embodiment of a nozzle constructed according to the present invention with the nozzle illustrated in a moving position;

FIG. 2 is a sectional, elevational view of the first nozzle embodiment shown in FIG. 1C with the embodiment illustrated in a pipe cutting position;

FIG. 3 is a plan view of the first nozzle embodiment shown in FIG. 1C, taken along lines 3—3 in the direction of the arrows;

FIG. 4 is a plan view of the first nozzle embodiment shown in FIG. 1C, taken along lines 4—4 in the direction of the arrows;

FIG. 5 is a sectional, elevation view of a second embodiment of a nozzle constructed according to the present invention with the embodiment illustrated in a moving position;

FIG. 6 is a sectional, elevation view of the second nozzle embodiment shown in FIG. 5 with the embodiment illustrated in a pipe cutting position;

FIG. 7 is a plan view of the second nozzle embodiment shown in FIG. 5, taken along lines 7—7 in the direction of the arrows; and FIG. 8 is a plan view of the second nozzle embodiment shown in FIG. 5, taken along lines 8—8 in the direction of the arrows.

Turning now to the drawings, there is shown apparatus 10 for cutting a pipe 12 disposed in a pipe string 14 extending from the surface of the earth down a borehole.

As best seen in FIGS. 1A and 1B, an anchor subassembly 16 is connected to conventional wire line apparatus 18 for moving pipe cutting apparatus 10 downwardly and laterally through pipe string 14. Anchor subassembly 16 may be of any conventional design, but preferably employs a cyclic J-slot system provided within an elongated tubular body 20. Extending downwardly away from body 20 is a movable tubular core 22 joined to a shoulder 24, which tapers outwardly from the elongate axis of body 20. Jaws 26 extend arcuately around movable extension 22 and downwardly from the lower end of body 20. Jaws 26 move into engagement with pipe string 14 by moving tubular core 22 and shoulder 24 laterally toward body 20. Upon engagement of jaws 26 with pipe string 14, pipe cutting apparatus 10 is prevented from moving during pipe cutting operations. Drag springs 28 may be provided around body 20 to inhibit damage caused upon impact with pipe string 14.

As best seen in FIGS. 1B and 1C, an igniter subassembly 30 for igniting combustible, pyrotechnic material used in pipe cutting apparatus 10 is connected to anchor subassembly 16. Igniter subassembly 30 includes an upper portion 32 and a lower portion 34. A body 36 is included in upper portion 32 and has a shoulder 38 at its lower end. A body 40 is included in lower portion 34 and is threadedly connected to shoulder 38. A passageway 42 is defined in body 40 and is adapted to and receives a squib 44 for igniting the combustible material in apparatus 10. Squib 44 is set off by an electric current, which is carried through electric conductors leading from the earth's surface down through pipe string 14 into body 36 of upper portion 32. The electric current is passed from body 36 to squib 44 by an electrode plug 46, a brass prong 48, a steel conductor 50 and a spring 52. Plug 46 is threadedly connected in the interior of upper portion body 36 with two O-ring seals 37 mounted on the plug to prevent the passage of fluids between upper portion 32 and lower portion 34. Steel conductor 50 includes a generally flat head portion 54 facing toward squib 44 and a stem portion 56 extending away from head portion 54 on the side opposite of squib 44. Spring 52 is disposed between steel conductor 50 and a shoulder 57 on lower portion body 40 to urge brass prong 48 into engagement with plug 46. A nut 58 is threadedly connected to stem portion 56 and an insulating washer 60 to prevent a short of the electric current is disposed around stem portion 56 between nut 58 and shoulder 38.

As best seen in FIG. 1C, a torch mechanism 62 for cutting pipe 12 disposed in pipe string 14 is threadedly connected to the lower end of body portion 34 of igniter subassembly 30. Torch mechanism 62 includes an elongated body 64 adapted to be lowered down pipe string 14 to pipe 12 with the elongate axis of body 64 extending along the axis of pipe string 14. A sleeve provides a chamber defined by external walls for body 64 and has a length extending between a first or upper end 68 and a second or lower end 70. The length is sufficient to enclose and support a sufficient quantity of solid combustible pyrotechnic material 72 to provide a pipe cutting frame of sufficient duration to cut pipe 12. Body 64 has an elongate axis and is adapted to be lowered at first end 68 down pipe string 14 to pipe 12 and adapted to direct the pipe cutting frame provide by combustible material 72 along the elongated axis toward second end 70. Internal threads 74 are provided in an internally disposed counterbore 76 extending from second end 70.

Combustible, pyrotechnic material 72 may be made from conventional material which is compressed into a pellet 78 of a generally donut configuration so as to permit stacking within sleeve 66 of body 64. The "hole" in each pellet 78 is generally coaxially aligned with squib passageway 42 in lower portion 40 of igniter subassembly 30. Loosely packed combustible material 80, preferably the same material used in forming pellets 78, is disposed within the "holes" of pellets 78 such that each pellet 78 becomes ignited from loosely packed combustible material 80 after ignition by squib 44.

As best seen in FIGS. 1C-4, a first embodiment of nozzle apparatus 100 may be connected to second end 70 of elongated body 64 of torch mechanism 62. Nozzle mechanism 100 directs the pipe cutting flame from a direction extending along the elongate axis of body 64 toward pipe 12.

A shield 102 is included in nozzle mechanism 100 and is made from heat resistant material. Shield 102 is disposed within counterbore 76 and has a plurality of passageways 104, preferably eight disposed equidistant from one another around the edge, that extend downwardly substantially parallel to the elongate axis of sleeve 66. A conical head 106 is provided on shield 102 to direct the pipe cutting flame into the mouths of plurality of passageways 104.

A closure 108 connects shield 102 to sleeve 66. Closure 108 has a connecting portion 110 with external threads 112 threadedly connected to internal threads 74 provided at second end 70 of sleeve 66. A passageway 114 is aligned with each passageway 114 in shield 102 and is lined with a sleeve 115 made of heat resistant material. A spindle portion 116 extends downwardly away from connecting portion 110 with external threads 118 provided on its outboard end 120.

A retainer 122 locks closure 108 to sleeve 66. Retainer 122 has a disk-like body 124 made of heat resistant material that defines a passageway 126 aligned with each passageway 114 in closure 108. A passage 127 is defined in body 124 to receive spindle portion 116 of closure 108.

A diverter 128 is constructed from heat resistant material to direct a pipe cutting flame radially of the elongate axis of body sleeve 66. Diverter 128 has a body 130, which includes a truncated cone-like portion 132 disposed adjacent retainer body 124 to form a pipe cutting flame deflecting shoulder that directs the pipe cutting flame radially of the elongate axis of body sleeve 66. A cylindrical portion 134 extends downwardly away from the base of cone-like portion 132. A passage 136 is defined in body 130 to receive spindle 116 of closure 108.

An end cap 138 is used in nozzle mechanism 100 for securing diverter 128 to retainer 122. A solid cylindrical portion 140 is used in end cap 138 to support cylindrical portion 134 of diverter 128. A passage 142 is defined in cylindrical portion 40 and has internal threads 144 engaging external threads 146 provided on spindle portion 116 of closure 108 so that rotating end cap 138 around the axis of spindle portion 116 urges diverter 128 against retainer 122. A shoulder portion 148 extends outwardly around cylindrical portion 138 to form a downwardly facing lip.

A removable cover 150 prevents foreign matter from passing into nozzle mechanism 100. Cover 150 includes a tubular sleeve 152 which has a length sufficient to extend between end cap 138 and sleeve 66. A portion of the outer periphery of sleeve 66 is removed to allow tubular sleeve 152 to be made up with a smooth exterior surface to assist in preventing snags when pipe cutting apparatus 10 is lowered down pipe string 14. An inwardly extending annular shoulder 154 is provided on the lower end of tubular sleeve 152 to engage the downwardly facing lip on outwardly extending shoulder 148. An upper O-ring 156 is provided on sleeve 66 near second end 70 and a lower O-ring 158 is provided on solid portion 140 near shoulder 148 to prevent fluid flow around cover 150 on the shoulder formed by cone-like portion 132 of diverter 128. A snap ring 160 is disposed around cylindrical portion 140 on end cap 138 to prevent inadvertent movement of cover 150 downwardly from shoulder 148 of end cap 138.

As best seen in FIGS. 5–8, a second embodiment of nozzle apparatus 200 may be connected to second end 70 of elongated body 64 of torch mechanism 62. Similar to first embodiment 100, second embodiment 200 directs the pipe cutting flame from a direction extending along the elongate axis of body 64 toward pipe 12.

A liner 202 made of heat resistant material is used in nozzle mechanism 200. Liner 202 has a tubular extension 204 defining three slots 206, 208 and 210 which are disposed radially of the elongate axis of body 64 and are equidistant from one another. Each slot 206, 208 and 210 has a length extending arcuately around tubular extension 204. A shoulder 212 extends annularly around the upper end of tubular extension 204 and is disposed within counterbore 76. The interior of shoulder 212 on tubular extension 204 is beveled to direct the pipe cutting frame inwardly of tubular extension 204.

A diverter 214 made of heat resistant material is used in nozzle mechanism 200. A conical portion 216 is formed on diverter 214 to provide a shoulder that directs the pipe cutting flame toward slots 206, 208 and 210. The upper surface of the base of conical portion 216 is in substantial juxtaposition with the lower edge of slots 206, 208 and 210, the lower edge being nearest lower end 218 of tubular extension 204 of liner 202. A solid cylindrical portion 220 extends downwardly away from the base of conical portion 216. A shoulder 222 extends annularly around cylindrical portion 220 and outwardly therefrom for a distance such that the outer perimeter of shoulder 222 is generally aligned with the outer periphery of tubular extension 204 of liner 202.

A cup-like end cap 224 secures liner 202 and diverter 214 to sleeve 66 of body 64. A tubular extension 226 is formed in end cap 224 with external threads 228 provided on an open end 230 to threadedly engage internal threads 74 provided on sleeve 66 of body 64. Slots 232, 234 and 236 are aligned with respective slots 206, 208 and 210 in tubular extension 204 of liner 202. A plug portion 238 closes the lower end of tubular extension 226 of end cap 224 and forms a shoulder that engages shoulder portion 222 of diverter 216.

A removable cover 240 prevents foreign matter from passing into nozzle mechanism 200. A tubular sleeve 242 is used in cover 240 and has a length sufficient to extend between sleeve 66 and end cap 224. A portion of the outer periphery of sleeve 66 is removed to allow tubular sleeve 242 to be made up with a smooth outer surface to assist in preventing snags when pipe cutting apparatus 10 is lowered down pipe string 14. An inwardly extending annular shoulder 244 is provided on the lower end of sleeve 242 to engage the outer perimeter of plug portion 238 on tubular end cap 224. An upper O-ring 246 is provided on sleeve 66 near second end 70 and a lower O-ring 248 is provided on plug portion 238 of end cap 224 to prevent fluid flow around cover 240 into slots 232, 234 and 236. A snap ring 250 is disposed around plug portion 238 on end cap 224 to prevent inadvertent movement of cover downwardly off of end cap 224.

In operation, pipe cutting apparatus 10 is lowered down pipe string 14 with wire line apparatus to the location where pipe 12 is to be cut, generally immediately above where string 14 is stuck. Anchor subassembly 16 is manipulates so that movable extension 22 moves laterally of body 20 to urge jaws 26 into engagement with pipe string 14 and thereby prevent movement of body 64 relative to pipe string 14 while pipe 12 is being cut. Electric current is passed from the surface of the earth through electric conductors to electrode plug 46, prong 48, conductor 50 and spring 52 to squib 44 located near first end 68 of body 64. Loosely packed combustible pyrotechnic material 80 supported in body 64 is ignited which in turn ignites compressed combustible, pyrotechnic material pellets 78. Body 64 directs the pipe cutting flame toward second end 70. Nozzle mechanism, either first embodiment 100 or second embodiment 200, directs the pipe cutting flame from the direction along the elongate axis of body 64 radially against pipe 12. In first embodiment 100, the pipe cutting flame is directed by concial portion 106 into passageways 104, 114 and 126, and onto the shoulder formed by cone-like portion 231 toward pipe 12. Cover 150 in first embodiment 100 is propelled downwardly from and off the nozzle mechanism as the pipe cutting flame generates sufficient pressure to act on annular shoulder 154. In second embodiment 200, the pipe cutting flame is directed through a passageway formed by tubular extension 204 of liner 202 onto the shoulder formed by conical portion 216 through slots 206, 208 and 210 in liner 202 and slots 232, 234 and 236 in end cap 224 toward pipe 12. Cover 240 in second embodiment 200 is propelled downwardly from and off the nozzle mechanism as the pipe cutting flame generates sufficient pressure to act on annular shoulder 244. The pipe cutting flame passes outwardly of the nozzle mechanism and contacts and cuts pipe 12.

The invention having been described, what is claimed is:

1. Apparatus for cutting a pipe disposed in a pipe string extending from the surface of the earth down a borehole, comprising: a body having an elongate axis and adapted to be lowered at a first end down the pipe string to the pipe to be cut, to support a quantity of solid combustible material for providing a pipe cutting flame and to direct the pipe cutting flame along the elongate axis toward a second end of said body; and nozzle means connected to the second end of said body for directing the pipe cutting flame from the elongate axis of said body radially against the pipe to be cut, said nozzle means including a diverter made of heat resistant material, the diverter having a shoulder to receive the pipe cutting flame directed along the elongate axis of said body and to direct the pipe cutting flame radially of the elongate axis of said body.

2. Apparatus as set forth in claim 1, further comprising: removable cover means connected to said nozzle means for preventing foreign matter from passing into said nozzle means.

3. Apparatus as set forth in claim 1, further comprising: said nozzle means including an end cap engaging the diverter and means for connecting the end cap to said body.

4. Pipe cutting apparatus adapted to be moved from the surface of the earth down a pipe string provided in a borehole, comprising: a body having an elongate axis; a solid combustible material disposed in said body to provide a pipe cutting flame; and nozzle means connected to said body for directing the pipe cutting flame from a direction extending along the elongate axis of said body toward the pipe to be cut, said nozzle means including a diverter made of heat resistant material, the diverter having a shoulder to receive the pipe cutting flame directed along the elongate axis of said body and to direct the pipe cutting flame radially of the elongate axis of said body.

5. Pipe cutting apparatus as set forth in claim 4, further comprising: removable cover means connected to said nozzle means for preventing foreign matter from passing into said nozzle means.

6. Pipe cutting apparatus as set forth in claim 4, further comprising: anchor means connected to said body for preventing movement of said body relative to the pipe string when the pipe is being cut.

7. Pipe cutting apparatus as set forth in claim 4, further comprising: means connected to said body for igniting said combustible material from the surface of the earth.

8. Pipe cutting apparatus as set forth in claim 7, further comprising: anchor means connected to said body for preventing movement of said body relative to the pipe string when the combustible material is ignited.

9. Pipe cutting apparatus as set forth in claim 4, further comprising: said body including a sleeve; and said solid combustible material being a plurality of pellets of a generally donut configuration so as to permit stacking within said body sleeve and so as to receive loosely packed combustible material within the holes of the donut configured pellets such that each pellet becomes ignited from the loosely packed combustible material.

10. Pipe cutting apparatus as set forth in claim 4, further comprising: said nozzle means including an end cap engaging the diverter and means for connecting the end cap to said body.

11. A tool for cutting a pipe disposed in a pipe string extending from the surface of the earth down a borehole, comprising: an elongated body adapted to be lowered down the pipe string to the pipe to be cut with the elongate axis of said body extending along the axis of the pipe string including a sleeve having a length extending between first and second ends sufficient to enclose and support a sufficient quantity of solid combustible material to provide a pipe cutting flame to cut the pipe and internal threads provided in an internally disposed counterbore extending from the second end; nozzle means for directing the pipe cutting flame from a direction extending along the elongate axis of said body toward the pipe to be cut including a shield disposed within the counterbore extending from the second end of the sleeve of said body having a plurality of passageways extending substantially parallel to the elongate axis of the sleeve of said body and a conical head to direct the pipe cutting flame into the plurality of passageways, a closure connecting the shield to the sleeve of said body having a connecting portion with external threads threadedly connected to the internal threads provided at the second end of the sleeve of said body, a passsageway aligned with each passageway in the shield and a spindle portion extending away from the connecting portion with external threads provided on the outboard end, a retainer disposed adjacent the closure having a disk-like body with a passageway aligned with each passageway in the closure and a spindle receiving passageway receiving the spindle portion of the closure, a diverter constructed from heat resistant material having a body with a truncated cone-like portion disposed adjacent the retainer body to form a pipe cutting flame directing shoulder which directs the pipe cutting flame radially of the elongate axis of said body sleeve, a cylindrical portion extending away from the base of the cone-like portion and a passageway receiving the spindle of the closure, an end cap having a solid cylindrical portion engaging the cylindrical portion of the body of the diverter and defining a passage with internal threads engaging the external threads provided on the spindle of the closure and a shoulder portion extending outwardly around the cylindrical portion; and a removable cover to prevent foreign matter from passing into said nozzle means including a tubular sleeve having a length extending between the end cap of said nozzle means and the sleeve of said body and an inwardly extending annular shoulder provided on one end which engages the outwardly extending shoulder on the end cap to enclosed said nozzle means.

12. A tool for cutting a pipe disposed in a pipe string extending from the surface of the earth down a borehole, comprising: an elongated body adapted to be lowered down the pipe string to the pipe to be cut with the elongate axis of said body extending along the axis of the pipe string including a sleeve having a length extending between first and second ends sufficient to enclose and support a sufficient quantity of solid combustible material to provide a pipe cutting flame to cut the pipe and internal threads provided in an internally disposed counterbore extending from the second end; nozzle means for directing the pipe cutting flame from a direction extending along the elongate axis of said body toward the pipe including a liner made of heat resistant material having a tubular extension defining three slots disposed equidistant from one another, each slot having a length extending arcuately around the tubular extension, and a shoulder extending annularly around the end of the tubular extension disposed within the counterbore and being beveled to direct the pipe cutting flame inwardly of the tubular extension, a diverter made of heat resistant material having a conical portion forming a shoulder to direct the pipe cutting flame toward the slots which are disposed radially of the elongate axis of said body, the base of the conical portion being in substantial juxtaposition with the edge of the slots nearest the end of the tubular extension of the liner, a solid cylindrical portion extending away from the base of the conical portion and a shoulder extending annularly around the cylindrical portion and outwardly therefrom for a distance such that the outer edge of the shoulder is generally aligned with the outer edge of the tubular extension of the liner, an end cap securing the liner and diverter to the sleeve of said body having a tubular extension with external threads on a first end threadedly engaging the internal threads provided on the sleeve of said body and defining a slot aligned with a respective slot in the tubular extension of the liner and a plug portion closing the end of the tubular extension of the end cap and forming a shoulder engaging the shoulder portion of the diverter; and a removable cover to prevent foreign matter from passing into said nozzle means including a tubular sleeve having a length extending between the sleeve of said body and the end cap of said nozzle means and an inwardly extending annular shoulder provided on one end which engages the outer perimeter of the plug portion on the tubular end cap.

13. Apparatus for cutting a pipe disposed in a pipe string extending from the surface of the earth down a borehole, comprising: a body having an elongate axis and adapted to be lowered at a first end down the pipe string to the pipe to be cut, to support a quantity fo solid combustible material for providing a pipe cutting flame and to direct the pipe cutting flame along the elongate axis toward a second end of said body; and nozzle means connected to the second end of said body for directing the pipe cutting flame from the elongate axis of said body radially against the pipe to be cut, said nozzle means including a diverter made of heat resistant material having a shoulder to direct the pipe cutting flame radially of the elongate axis of said body, an end cap engaging the diverter, means for connecting the end cap to said body, a shield to direct the pipe cutting flame into a plurality of passageways leading to the shoulder on the diverter, and a conically shaped head to direct the pipe cutting flame into the plurality of passageways.

14. Apparatus for cutting a pipe disposed in a pipe string extending from the surface of the earth down a borehole, comprising: a body having an elongate axis and adapted to be lowered at a first end down the pipe string to the pipe to be cut, to support a quantity of solid combustible material for providing a pipe cutting flame and to direct the pipe cutting flame along the elongate axis toward a second end of said body; and nozzle means connected to the second end of said body for directing the pipe cutting flame from the elongate axis of said body radially against the pipe to be cut, said nozzle means including a diverter made of heat resistant material having a shoulder to direct the pipe cutting flame radially of the elongate axis of said body, a tubular end cap securing the diverter to said body with a plurality of slots extending arcuately around the tubular end cap, and a liner made of heat resistant material with a slot for each slot in the tubular end cap, each slot in the liner being aligned with a respective slot in the end cap.

15. Pipe cutting apparatus adapted to be moved from the surface of the earth down a pipe string provided in a borehole, comprising: a body having an elongate axis; a solid combustible material disposed in said body to provide a pipe cutting flame; and nozzle means connected to said body for directing the pipe cutting flame from a direction extending along the elongate axis of said body toward the pipe to be cut, said nozzle means including a diverter made of heat resistant material having a shoulder to direct the pipe cutting flame radially of the elongate axis of said body, an cap engaging the diverter, means for connecting the end cap to said body, a shield to direct the pipe cutting flame into a plurality of passageways leading to the shoulder on the diverter, and a conically shaped head to direct the pipe cutting flame into the plurality of passageways.

16. Pipe cutting apparatus adapted to be moved from the surface of the earth down a pipe string provided in a borehole, comprising: a body having an elongate axis; a solid combustible material disposed in said body to provide a pipe cutting flame; and nozzle means connected to said body for directing the pipe cutting flame from a direction extending along the elongate axis of said body toward the pipe to be cut, said nozzle means including a diverter made of heat resistant material having a shoulder to direct the pipe cutting flame radially of the elongate axis of said body, a tubular end cap securing the diverter to said body with a plurality of slots extending arcuately around the tubular end cap, and a liner made of heat resistant material with a slot for each slot in the tubular end cap and with each slot in the liner being aligned with a respective slot in the end cap.

* * * * *